US006247690B1

(12) United States Patent
Wolf

(10) Patent No.: US 6,247,690 B1
(45) Date of Patent: Jun. 19, 2001

(54) FIXTURING TOOL FOR RETAINING AND POSITIONING SMALL OBJECTS

(76) Inventor: Hugh M. Wolf, 2343 S. Embers La., Arlington Heights, IL (US) 60005

( * ) Notice: Subject to any disclaimer, the term of this patent is extended or adjusted under 35 U.S.C. 154(b) by 0 days.

(21) Appl. No.: 09/453,369

(22) Filed: Dec. 1, 1999

(51) Int. Cl.[7] ..... B25B 1/24

(52) U.S. Cl. ..... 269/277; 269/902; 269/287; 269/279

(58) Field of Search ..... 269/277, 902, 269/271, 313, 314, 279, 280, 287

(56) References Cited

U.S. PATENT DOCUMENTS

| | | | | |
|---|---|---|---|---|
| 2,455,024 | * | 11/1948 | Schneider | 269/277 |
| 2,932,995 | * | 4/1960 | Durfee | 269/277 |
| 3,188,076 | | 6/1965 | Pryor . | |
| 3,218,059 | * | 11/1965 | Andrew | 269/277 |
| 3,345,061 | | 10/1967 | Schaefer . | |
| 3,967,816 | | 7/1976 | Ramsperger . | |
| 3,980,287 | | 9/1976 | Nilsson . | |
| 4,005,945 | | 2/1977 | Gutman . | |
| 4,139,189 | * | 2/1979 | Wietrzyk | 269/277 |
| 4,153,239 | | 5/1979 | La Rocco . | |
| 4,655,654 | | 4/1987 | Portas . | |
| 4,669,227 | | 6/1987 | Treppner . | |
| 4,854,568 | | 8/1989 | Baeza . | |
| 4,898,238 | * | 2/1990 | Grantom | 269/277 |
| 5,308,582 | * | 5/1994 | Serra | 269/277 |
| 5,599,007 | * | 2/1997 | Oliveria | 269/271 |

FOREIGN PATENT DOCUMENTS 2831-324 1/1980 (DE) .

* cited by examiner

*Primary Examiner*—Joseph J. Hail, III
*Assistant Examiner*—Lee Wilson
(74) *Attorney, Agent, or Firm*—Robert L. Marsh

(57) ABSTRACT

A fixturing tool has an elongate body with a polygon cross section so as to define a plurality of sides. At least one annular groove extends around the circumference of the body thereby dividing each of the sides into a plurality of segments. At least one longitudinal groove extends across the plurality of segments which comprise one of the sides of the fixturing tool for retaining a work piece therein.

8 Claims, 2 Drawing Sheets

FIXTURING TOOL FOR RETAINING AND POSITIONING SMALL OBJECTS

The present invention relates to fixturing tools used to retain and position objects in the machining industry and, in particular, to a fixturing tool sized to retain and position small and intricate objects.

BACKGROUND OF THE INVENTION

The tool and die industry involves the machining of both large and small parts and frequently it is necessary to work a very small object on a machine designed to accept a much larger workpiece. Such machines have vises and clamps sized to retain the largest work piece that the machine is intended to receive, however such vises and clamps are unsuitable for retaining miniaturized workpieces. To adapt such machines to receive very small workpieces, a fixturing tool is employed which has a mounting portion for fitting within the jaws of the vise or clamp of the machine and a retaining portion, often configured as a "V", for retaining a miniature workpieces.

While small objects may be considered as constituting a single group, in reality, there are substantial differences of scale between sizes of such objects and, therefore, it is common to provide a plurality of sizes of fixturing tools to receive the many different sizes of small parts which can be machined. A tool and die maker, therefore, must maintain a multiplicity of sizes of fixturing tools for the machines which may be employed to accept small parts. It would be desirable, therefore, to provide a single fixturing tool which could be retained in the vise of a machine and could hold a multiplicity of sizes of small parts. It would also be desirable to have a fixturing tool that would be useable in conjunction with products such as V-blocks, and with angle plates, inspection equipment, integrated tooling, or as a standing alone retainer.

SUMMARY OF THE INVENTION

Briefly, the present invention is embodied in a fixturing tool having an elongate body with a principle longitudinal axis and a polygon cross sectional shape so as to define a plurality of sides. The outer surface of the body has at least one annular groove extending radially therein that divides each of the sides thereof into a plurality of segments. The groove defines a plane perpendicular to the principle longitudinal axis of the fixturing tool body, and the grove defines a first face and an opposing second face parallel to the first face with a distance between them. At least one longitudinal groove extends across a plurality of segments of one of the sides of the fixturing tool body.

The fixturing tool is used in conjunction with a clamp and a bridge. The clamp has a generally rectangular shape with parallel sides, an outer end, a clamp end and a generally rectangular central opening. The parallel sides are spaced a distance which is a little greater than the distance between parallel sides of the fixturing tool body, and the outer end is spaced from the clamp end a distance substantially greater than the distance between parallel sides of the fixturing tool body. In the preferred embodiment, the sides and outer end of the clamp have a thickness which is a little less than the distance between the parallel faces. The clamp end has a threaded bore therein through which a thumb screw is fitted, with the screw directed generally towards the center of the rectangular central opening.

The bridge has a body with a central portion and parallel legs, the end surfaces of which are angled to rest upon sides of the elongate body of the fixturing tool. The bridge may be used in conjunction with the fixturing tool to hold an elongate workpiece by retaining the fixturing tool in a vise between the jaws of the machine with the length of the workpiece extending between legs of the bridge.

BRIEF DESCRIPTION OF THE DRAWINGS

A better and more complete understanding of the present invention will be had after a reading of the following detailed description taken in conjunction with the drawings wherein.

DETAILED DESCRIPTION OF THE PREFERRED EMBODIMENT

Figure 1:
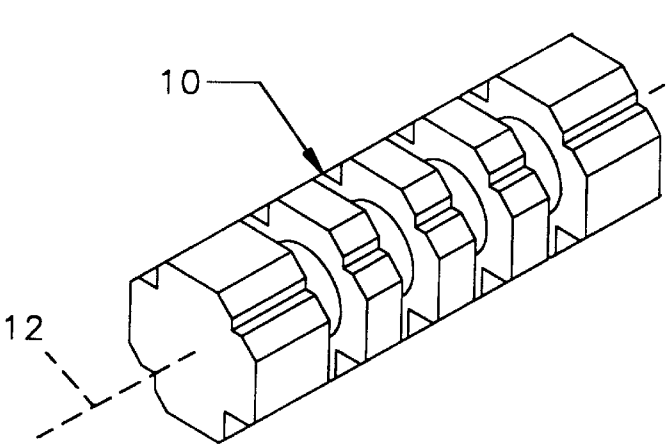
FIG. 1 is an isometric view of a fixturing tool in accordance with the present invention.
Figure 2:
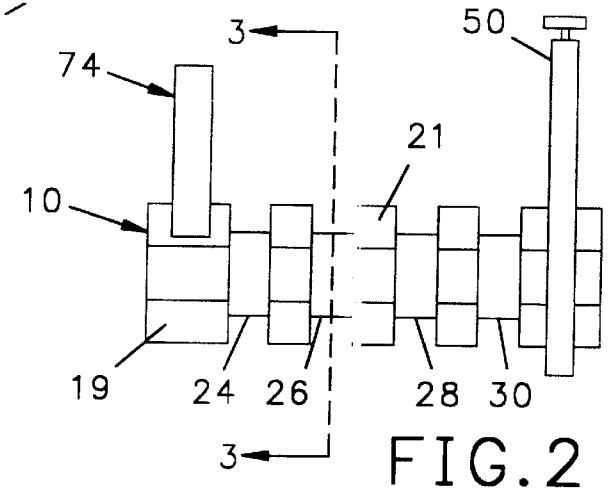
FIG. 2 is a side elevational view of the fixturing tool shown in FIG. 1 with a bridge at one end thereof and a clamp at the other end thereof.
Figure 3:
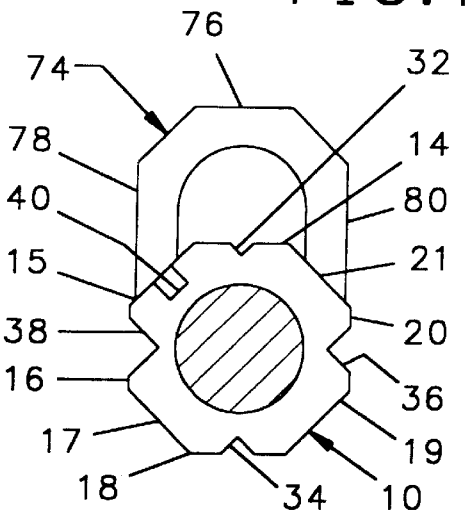
FIG. 3 is an enlarged cross sectional view of the fixturing tool and bridge shown in FIG. 2 taken through line 3—3 thereof.

Referring to FIGS. 1, 2, and 3, a fixturing tool for retaining a plurality of sizes of small workpieces has an elongate body 10 with a polygon cross section with a longitudinal axis 12. In the preferred embodiment the cross sectional shape of a fixturing tool body 10 is that of an octagon with sides bearing indicia numbers 14 through 21. As best shown in FIGS. 2 and 3, the sides 14–21 of the body 10 are broken into segments by a plurality of inwardly extending radial grooves 24, 26, 28, 30.

As best shown in FIGS. 1 and 3, extending across all of the segments of one side 14 is a small V-shaped groove 32, the sides of which are parallel to sides 17 and 19 of the block body 10. Extending longitudinally across the segments of side 18 is a second, somewhat larger, groove 34. Extending longitudinally across the segments of side 20 is an even larger groove 36, and in similar fashion, extending across the segments of side 16 is the largest groove 38. Finally, extending longitudinally into the surfaces of the segments of side 15 is a fifth groove 40 with a rectangular cross section with opposing parallel sides parallel to sides 17 and 21 and bottom parallel to sides 15 and 19.

In the preferred embodiment, the block body 10 has an overall length of approximately 2¾" and a width across opposing sides (for example sides 14 and 18) of the octagon of ⅞". The faces defining the sides of each of the groves 24, 26, 28, 30 are spaced a distance of ¼" from each other and the depth of each groove, from the flat of an associated side 14–21 to the cylindrical surface defining the bottom thereof, is approximately 3/16". The bottom of the groves 24, 26, 28, 30 define a cylinder with a diameter of ½ inches.

Figure 6:
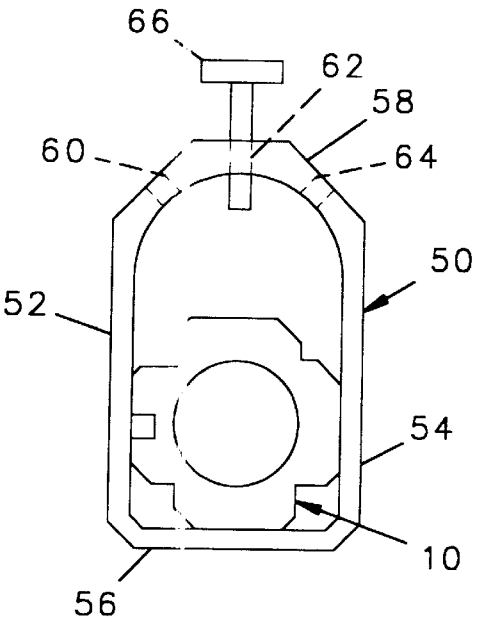
FIG. 6 is a cross sectional view of the fixturing tool shown in FIG. 2 showing a front elevational view of the clamp attached thereto.
Figure 8:
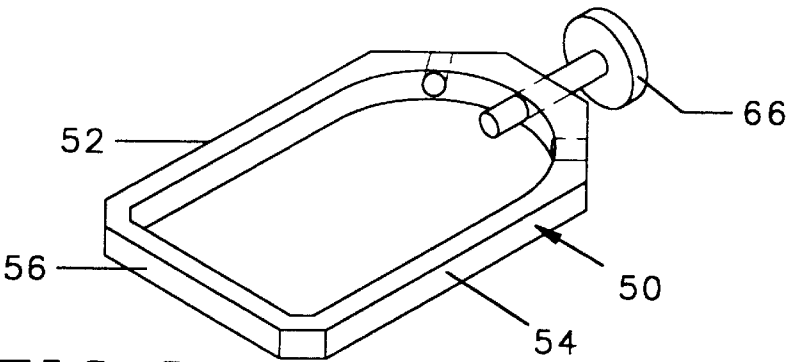
FIG. 8 is a isometric view of the clamp of FIG. 6 with the inner portions thereof shown in broken lines.

Referring to FIGS. 2, 6, 7 and 8, the fixturing tool is used in conjunction with a clamp 50, the body of which defines the perimeter of an open rectangle, the body having side portions 52, 54, an end portion 56, and a head portion 58. The inner surfaces of the side portions 52, 54 are spaced a distance a little greater than the distance between parallel sides of the fixturing tool body 10 so that the clamp is slideable over the sides 14–21 of the block body 10. The head portion 58 is spaced from the end portion 56 a distance to enable a workpiece to be fitted between the head portion 58 and a side of the block body 10 when clamp 50 is fitted around the fixturing tool as best shown in FIG. 6. Extending through the head portion 58 are a plurality of threaded holes 60, 62, 64 into which a thumb screw 66 can be threaded with the distal end thereof directed towards the rectangular central opening to retain a workpiece fitted between the head portion 58 of the clamp and the block body 10.

Figure 7:
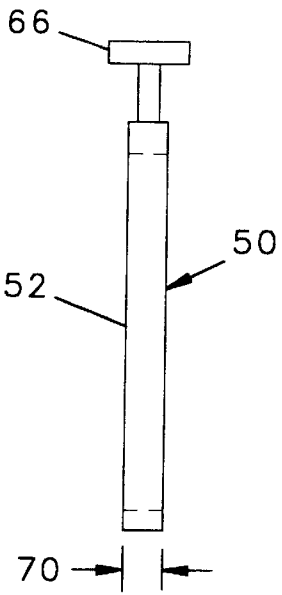
FIG. 7 is a side elevational view of the clamp shown in FIG. 6.

As best shown in FIG. 7, in the preferred embodiment the clamp 50 has a thickness 70 which is a little less than the spacing between the opposing faces of the grooves 24, 26, 28, 30. The clamp 50 will, therefore, fit into the groves 24, 26, 28, 30 so that it may be turned as needed to bring the desired groove 32, 34, 36, 38, 40 to engage a workpiece and be retained therein by on of the thumb screw 66 as shown in FIG. 6.

Figure 5:
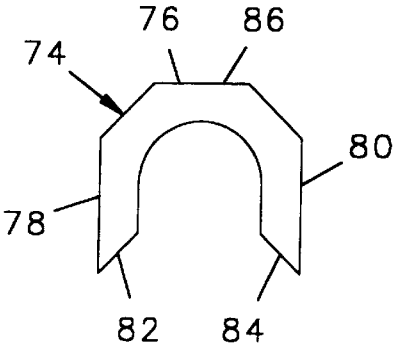
FIG. 5 is a front elevational view of the bridge shown in FIGS. 2 and 3.

As shown in FIGS. 2, 3 and 5, to accommodate a long work piece, the fixturing tool is useable in conjunction with a bridge 74. The bridge 74 is generally U-shaped, with a central portion 76 with opposing legs 78, 80 extending from opposite sides thereof. At the distal end of the legs 78, 80 are angled flats 82, 84 and the central portion has a third flat 86. In the preferred embodiment, where the fixturing tool has an octagon cross section, the central flat 86 is perpendicular to the direction of the legs 78, 80 and the angled flats 82, 84 are at right angles to each other and define a 45° angle with the plane of the central flat 86. The angled flats 82, 84 are spaced so they will rest upon angled sides 14–21 of the fixturing tool as shown in FIGS. 3 and 5. The fixturing tool can be retained between the jaws of a vice with one jaw compressed upon the central flat 86 of the bridge 70 and the other jaw compressed against the opposing surface 19 of the fixturing tool. An elongate workpiece 90 can be retained in a grove 34 by the clamp 50, and the elongate end of the workpiece 90 can extend along the associated groove 34 and through the legs 78, 80 of the bridge 74 as best shown in FIG. 5.

Figure 4:
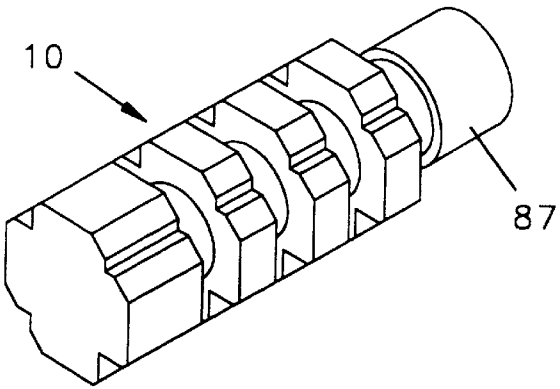
FIG. 4 is an isometric view of a second embodiment of the fixturing tool.

Referring to FIG. 4. The fixturing tool 10 may also be adapted for use with integrated tooling systems by providing at one end thereof an axially aligned cylindrical stud 87 having a diameter of 20 mm. The tool 10 may also be used with inspection equipment and other work holding fixtures such as V-blocks, or it may be free standing. As a free standing body the fixturing tool 10 can retain a workpiece while the fixturing tool body 10 rests on one of the unused flat surfaces thereof or on one of the ends. The octagon cross section of the tool offers eight surfaces 14–2l each of which can be formed to hold parts. The rectangularly shaped groove 40, for example, may have been custom sized to receive a specific object. Customized grooves may similarly be cut into any of the remaining unused surfaces 17, 19 and 21.

While the present invention is described with respect to two embodiments, it will be appreciated that many modifications and variations may be made without departing from the true spirit and scope of the invention. It is, therefore, the intent of the appended claims to cover all such modifications and variations which fall within the true spirit and scope of the invention.

What is claimed is:

1. A fixturing tool comprising an elongate body having a central longitudinal axis and an outer surface having a polygon shaped cross section, said cross section defining an octagon outer shape, said outer surface having at least one annular groove extending around said elongate body and radially therein which divides sides of said octagon outer shape into a plurality of segments, said groove defining planar faces perpendicular to said longitudinal axis including a first face and a parallel second face, with spacing between said first face and said second face, and a longitudinal groove in at least one of said sides extending across said plurality of segments thereof.

2. The fixturing tool of claim 1 wherein sides of said octagon as defined by said outer surface are all equal.

3. The fixturing tool of claim 1 and further comprising a cylindrical stud extending axially from said elongate body.

4. The combination comprising a fixturing tool in accordance with claim 2, and a clamp having a body with parallel sides, an outer end, and a clamp end, said parallel sides spaced a distance a little greater than the distance between parallel sides defining said octagon outer shape of said fixturing tool, said outer end and said clamp end spaced a distance greater than the distance between any two parallel sides forming said octagon cross sectional shape of said elongate body of said fixturing tool, said clamp having a thickness less than the distance between parallel faces of said annular groove, a threaded bore in said clam end, and a screw in said threaded bore.

5. The combination comprising the fixturing tool and clamp of claim 4 and further, a bridge having a body with a central portion and parallel legs, said legs extending perpendicular from a plane defined by said central body, each of said parallel legs having a lower surface, said lower surfaces angled at 45° with respect to said plane defined by said central body whereby said lower surfaces will rest upon sides defining said octagon shape.

6. A fixturing tool comprising an elongate body having central longitudinal axis and an outer surface having a polygon shaped cross section defining an octagon having eight sides, and a longitudinal groove in at least one of said sides of said octagon, and at least one radial groove in said elongate body, said radial groove extending around a circumference of said elongate body and dividing said sides into a plurality of segments.

7. A fixturing tool comprising an elongate body having a central longitudinal axis and an outer surface having a polygon shaped cross section defining an octagon, and a longitudinal groove in at least one side of said octagon, and a cylindrical stud extending axially from said elongate body.

8. A fixturing tool comprising an elongate body having a central longitudinal axis, said body having a polygon cross section, said polygon cross section of said body having eight outer corners all equidistant from said longitudinal axis whereby said eight outer corners define an octagon having eight equal surfaces, at least one of said eight surfaces having a longitudinal groove therein, and said elongate body having at least one annular groove extending radially into said body and dividing said eight surfaces into segments.

* * * * *